United States Patent [19]

Powell et al.

[11] Patent Number: 4,844,045

[45] Date of Patent: Jul. 4, 1989

[54] SELF-LOADING, REMOTELY OPERABLE AND VARIABLE, PORTABLE BALL THROWING APPARATUS AND METHOD

[75] Inventors: Richard Powell; Bert L. Powell, Jr., both of Austin, Tex.

[73] Assignee: Powell/Teeple Enterprises, Inc., Austin, Tex.

[21] Appl. No.: 199,515

[22] Filed: May 27, 1988

Related U.S. Application Data

[63] Continuation-in-part of Ser. No. 54,568, May 21, 1987, abandoned.

[51] Int. Cl.[4] ..... F41B 3/02

[52] U.S. Cl. ..... 124/7; 124/17; 124/36; 124/41 R; 124/80

[58] Field of Search ..... 124/7, 8, 17, 34, 35 R, 124/36, 41 R, 4, 5, 6, 80; 273/26 D

[56] References Cited

U.S. PATENT DOCUMENTS

| | | | |
|---|---|---|---|
| 894,738 | 7/1908 | Hindmarsh | 124/7 |
| 1,203,027 | 10/1916 | McMillan | 124/7 |
| 1,204,645 | 11/1916 | Boardman | 124/7 |
| 2,080,958 | 5/1937 | Beasley et al. | 124/7 |
| 2,082,818 | 6/1937 | Atwell | 124/7 X |
| 2,700,379 | 1/1955 | Brigati | 124/41 R X |
| 3,552,371 | 1/1971 | Kahelin | 124/7 |
| 3,722,494 | 3/1973 | Slevin | 124/7 |
| 4,082,076 | 4/1978 | Perry | 124/7 |
| 4,262,648 | 4/1981 | Wegener et al. | 124/6 |
| 4,271,813 | 6/1981 | Rowe | 124/7 |

*Primary Examiner*—Randolph A. Reese
*Assistant Examiner*—John Ricci
*Attorney, Agent, or Firm*—Arnold, White & Durkee

[57] ABSTRACT

A self-loading, remotely operable and variable, portable ball thrower. An arm with a hand attached thereto is, in the uncocked position, tensioned by an elastic biasing element, such as surgical tubing, in the forward direction. An individual batter, operator, can, by means of a cocking handle, operate the arm in the rearward direction, pick up a ball from a self-loading trough, and reset the arm in the cocked position. Assuming a natural batter's stance, the batter may then with his or her foot release the cocking handle thereby allowing the elastic biasing means to draw, with ever increasing speed, the arm towards the uncocked position. Upon reaching the uncocked position, the ball is released in a fluid throwing manner in a consistent angle towards the batter. The invention enables the batter to raise and lower the pitch in the batting zone by placing the cocking handle in one of a number of adjustment holes so that the batter may practice low or high pitches or different batters of different heights may rapidly adjust the pitch for their needs. Additionally, the device enables the individual batter to throw fly balls, strikes, or grounders. The device is easily disassembled and assembled, is lightweight, and portable.

8 Claims, 4 Drawing Sheets

FIG. 7
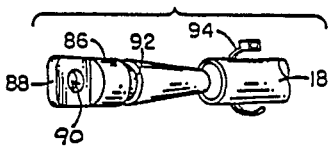
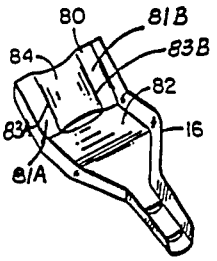
FIG. 6
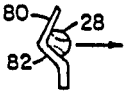
FIG. 6A
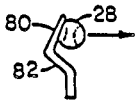
FIG. 6B
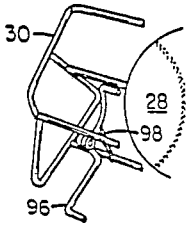
FIG. 8
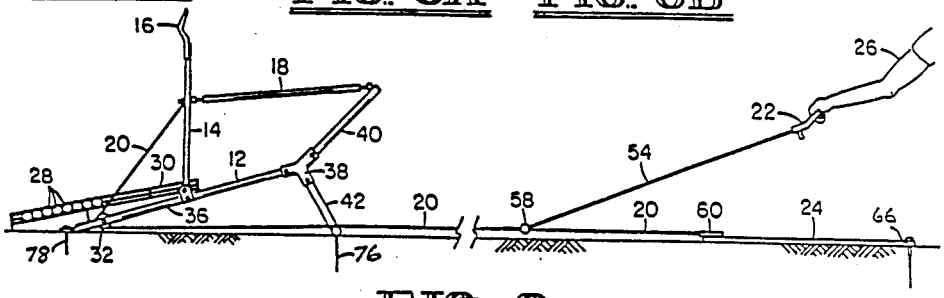
FIG. 9
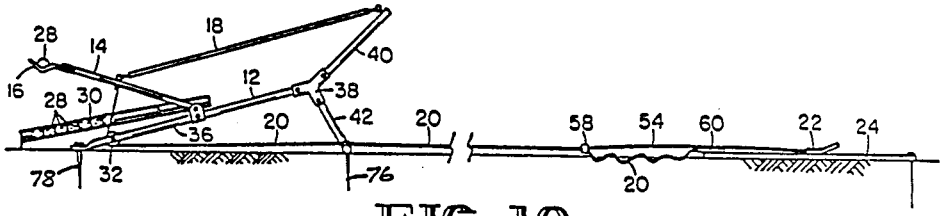
FIG. 10
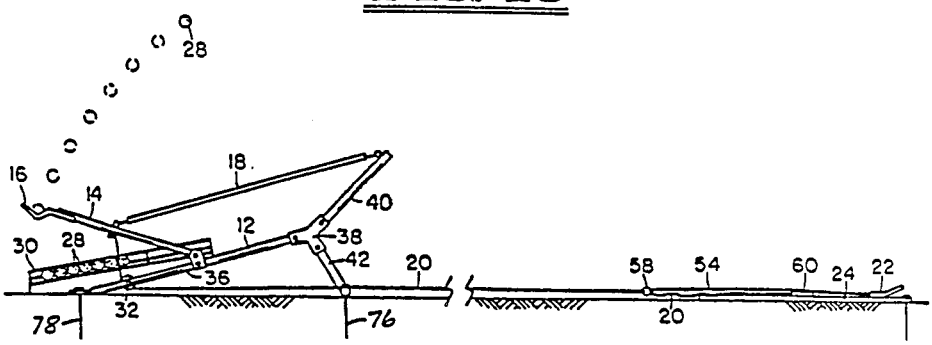
FIG. 11

SELF-LOADING, REMOTELY OPERABLE AND VARIABLE, PORTABLE BALL THROWING APPARATUS AND METHOD

This application is a continuation-in-part of co-pending application Ser. No. 054,568, filed May 21, 1987, now abandoned.

BACKGROUND OF THE INVENTION

This invention relates to an improved self-loading, remotely operable and variable, portable ball throwing device.

Both manual and automatically driven ball throwing mechanisms have been known in the art for quite some time. For example, a manual throwing device which holds a ball in a wire loop and "throws" a ball by knocking it out of the wire loop upon impact has been designed. An example of such a device is disclosed in Beasley, et al., U.S. Pat. No. 2,080,958 which incorporates the use of a wire loop on a handle which is pulled toward the top of a box and slammed against the box to cause the release of the ball. The operator of this Beasley device must remain behind the box to load the balls into the loop and to release the arms.

Another manually operated pitching machine is disclosed in Rowe, U.S. Pat. No. 4,271,813. The Rowe machine is a tripod designed to generally resemble a human being with a spring torsional arm that is drawn back by the batter to pick up a large softball. The batter then slips the pull string off of the bat as he stands at the plate, the arm is released and the softball is "thrown."

Yet another manually operated throwing device is disclosed in Perry, U.S. Pat. No. 4,082,076. This patent discloses a spring actuated throwing device designed to throw one ball, tethered to the ground, again and again. The ability to adjust the pitch up and down in the batter's box is limited and complicated to achieve, if at all. Any adjustments for speeds of pitches is equally difficult to achieve, if at all, and the device is complicated to assemble and position correctly. Also, the arm is limited in its range of motion.

Automatic ball machines, such as Nall, et al., U.S. Pat. No. 4,552,120, obviously require the presence of electricity and are typically mechanically complicated and expensive.

A drawback to the electrically powered ball throwers, and especially to the manually operated ball throwers known in the art, is that, should the batter desire to change the height of the pitch thrown, they require leaving the batter's box and making complicated and intricate changes that require considerable testing before the pitch is successfully changed. As a result, the ability to change the location of the pitch from pitch to pitch within the batter's box is nonexistent. Further, prior art devices are limited or incapable of altering the velocity of the pitches thrown; the height, either fly balls or ground balls, of the balls thrown; have no reliable self-loading mechanism; and cannot consistently throw a pitch over and over again in the same location.

Thus, there is a need in the art for providing a ball throwing device which is remotely adjustable and operable; self-loading; capable of alternating pitches, one after the other, up and down, within the batting box; capable of producing high and low velocity pitches; capable of throwing fly and ground balls; and which is simple in design, collapsible, and portable.

It, therefore, is an object of this invention to provide an improved remotely operable and variable, self-loading, portable ball throwing device.

SUMMARY OF THE INVENTION

Accordingly, one embodiment of the ball throwing device of the present invention includes a frame having an arm rotatably mounted thereon. A "hand" means for holding a ball is mounted to the free end of the arm. This hand means may include a pair of spaced, support members for releaseably supporting the ball during the throwing operation. One or more elastic biasing means, such as surgical tubing, are connected to the arm and to the frame and draw the arm towards the front of the frame. On the opposite side of the arm from the surgical tubing connection is one end of an arm positioning means, such as a nylon cord. The nylon cord is passed over a pulley at the rear of the frame and passes forward and concludes in a hook or anchoring means attached to the opposite end of the cord. A rectangularly shaped peg board is designed to receive and retain the anchor attached to the cord in one free end of the board. With the anchor attached, the peg board is drawn back until the arm is back to the vertical position. At that point, the peg board is secured to the ground by means of a stake driven through a hole in the rear end of the peg board. Attached between the ends of the positioning cord is a cocking handle. The cocking handle has a peg which conforms to holes drilled into the peg board numbered consecutively from "1" upward starting at the free end of the peg board where the anchor is located.

A removably attachable self-loading trough is attached to the frame and designed so as to admit a ball into the hand when the cocking handle draws the arm past horizontal to its full rearward position. In operation, the cocking handle is grasped, the handle is pulled away from the frame which draws the arm backwards, and a ball is loaded into the hand. The operator then places the cocking handle peg into a preselected hole in the peg board. The batter then assumes a natural batting stance and, with his foot, simply lifts the cocking handle slightly causing the peg to be withdrawn from the peg board and the surgical tubing to draw the arm forward in ever increasing speed until the ball is launched towards the batter. Should the batter desire to lower the pitch, he simply places the cocking handle in a number lower than the one first selected. If the batter desires to raise the pitch, he places the cocking handle in the number higher than the one first selected. The same pitch may be thrown again and again and again by simply replacing the cocking handle in the originally selected hole.

As an alternative embodiment, for use by two people, the cocking handle may be used simply to draw the arm backwards and then released using the peg board to retain the anchor only.

BRIEF DESCRIPTION OF THE DRAWINGS

Other objects, features, and advantages of the present invention will become more fully apparent from the following detailed description of the preferred embodiment, the appended claims, and the accompanying drawings in which:

FIG. 6 is a plan view of the "hand" of the invention;

FIG. 6A is a side view of the hand with a ball in the "normal" position;

FIG. 6B is a side view of the hand with a ball out of the "normal" position;

FIG. 7 is an exploded view of the connection means utilized to join the elastic biasing means to the frame;

FIG. 8 is a partial view of the operating mechanism of the self-loading trough;

FIG. 9 is a side view illustrating a batter preparing to pull the cocking handle and move the arm from the resting position;

FIG. 10 is a side view showing the invention in the cocked position;

FIG. 11 is a side view illustrating the position of the anchor and cocking handle for the delivery of a fly ball.

DETAILED DESCRIPTION OF THE PREFERRED EMBODIMENT

Figures 1, 2, 3:
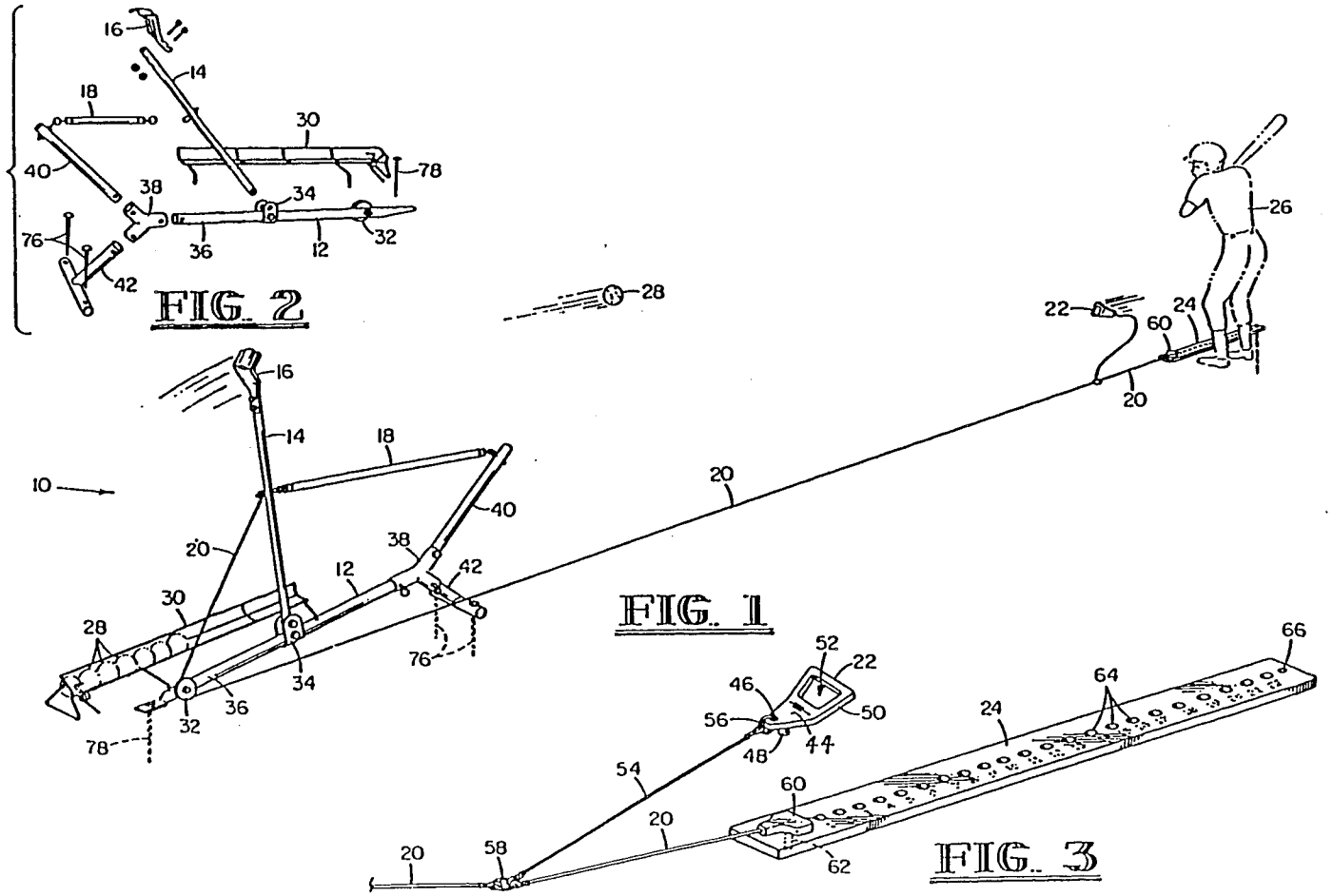
FIG. 1 is a plan view of a preferred embodiment of the ball throwing device of the present invention.
FIG. 2 is a view of the frame portion of the invention partially disassembled.
FIG. 3 is a plan view of the anchor, peg board, and cocking handle of the invention.

A preferred embodiment of the present invention is illustrated by way of example in FIGS. 1–11. With specific references to FIGS. 1, 2, and 3, a ball thrower 10 includes a frame 12, rotatably attached arm 14, hand 16, and power length 18. FIG. 1 also illustrates arm positioning cord 20, cocking handle 22, and peg board 24. Also shown are batter 26, ball 28, and self-loading trough 30.

Referring to FIG. 2, pulley 32, attached to frame 12, is shown along with rotatable attachment area 34. Also shown as parts of frame 12 are main stem section 36; "Y" connection 38 attached to frame 12; power section 40 attached to the upper length of "Y" connection 38; and dead man section 42 attached to the lower arm of "Y" connection 38.

FIG. 3 illustrates forward flat section 44 of cocking handle 22, attachment hole 46 in forward flat section 44, downward pointing peg 48, and upwardly sloping handle 50. The hole 52 through which the user may place his fingers to grasp handle 22 is also shown. Handle connecting cord 54 is shown connected by handle connection 56, of any conventional design known in the art, in this case a metal ring. Cord 54 is also connected by positioning cord connection 58 to arm positioning cord 20.

FIG. 3 also illustrates removably attachable anchor 60 which has a peg 62, shown in dotted lines, designed to conform to a large number of adjustment holes 64 as does peg 48. Peg board 24 has stake hole 66 through which any convenient stake (not shown) may be driven in order to secure peg board 24 to the ground.

Figure 4:
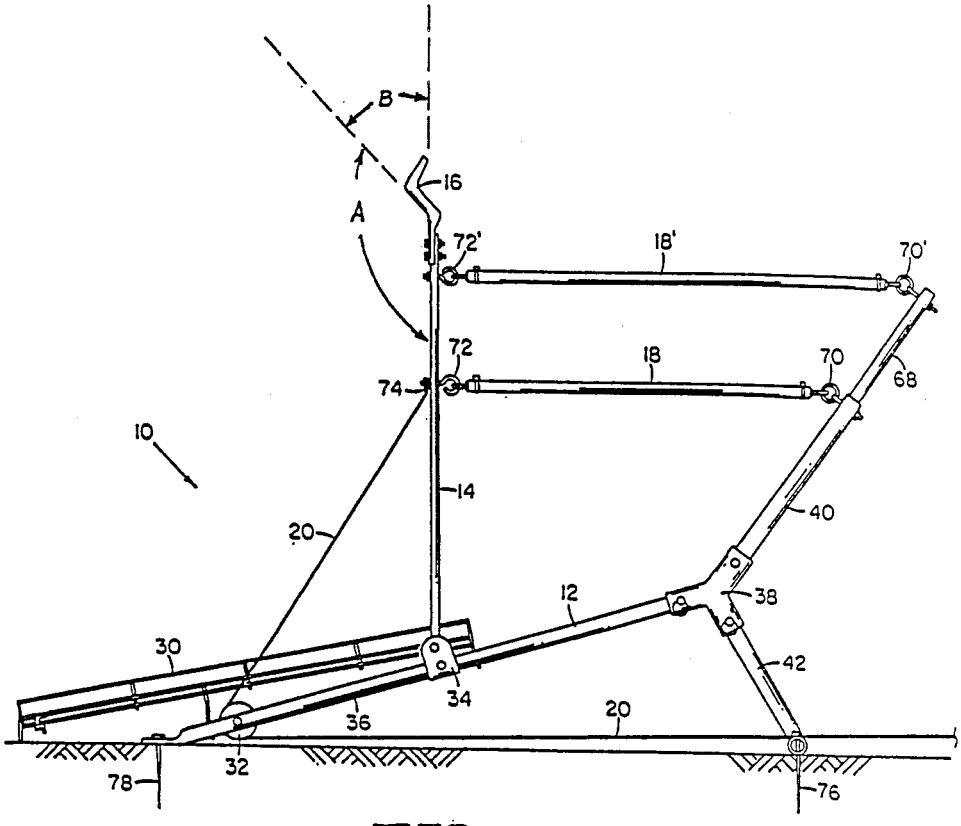
FIG. 4 is a side view of the invention in the uncocked position with self-loading trough attached.

Turning now to FIG. 4, ball thrower 10 is shown in the uncocked position. Also illustrated in FIG. 4 is supplemental power section 68 with additional power length 18'. Further, power section connections 70 and 70' are shown, in this instance consisting of hooks and rings of conventional design known in the art and not described further herein. Arm connections 72 and 72' are similarly disclosed, yet arm connections 72 and 72' have unclosed loops so that power lengths 18 and 18' may be easily removed and attached thereto.

As a result of this configuration, six to eight variations of speed are easily provided. For example, if power length 18 is designated as a length of $\frac{3}{4}''$ 0.D. surgical tubing, "A", in the low position and power length 18' is designated as a length of $\frac{5}{8}''$ 0.D. surgical tubing, "B", in the high position, the following eight positions, 1 to 8, slowest to fastest, are possible:

| | | | |
|---|---|---|---|
| 1. | High Position = None<br>Low Position = B | 2. | High Position = B<br>Low Position = None |
| 3. | High Position = None<br>Low Position = A | 4. | High Position = A<br>Low Position = None |
| 5. | High Position = B<br>Low Position = B | 6. | High Position = B<br>Low Position = A |
| 7. | High Position = A<br>Low Position = B | 8. | High Position = A<br>Low Position = A |

This speed range requires two of each type power length. Six speeds are available if only one type of each power length is used thereby excluding speeds 5 and 8 as set forth above.

Figure 5:
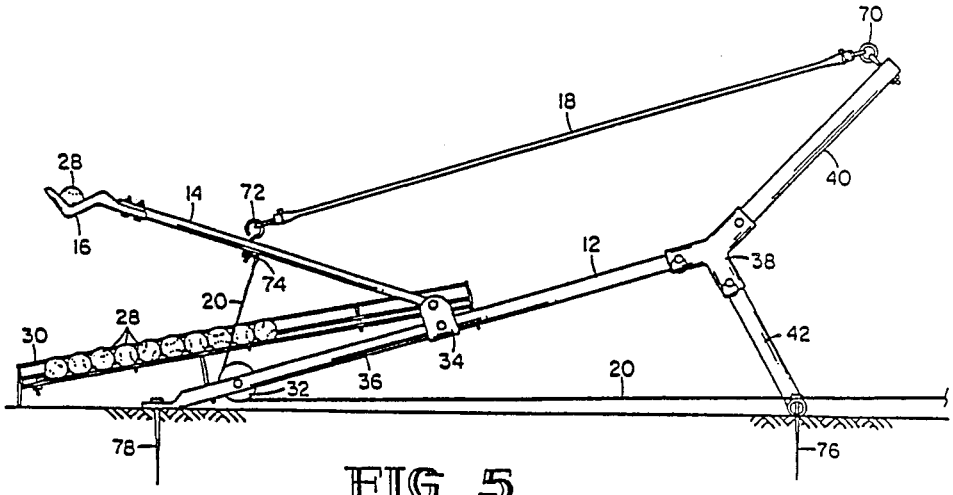
FIG. 5 is a side view of the invention in the cocked position, and self-loading trough with balls attached.

It should also be pointed out that a most important improvement of this invention, as illustrated in FIGS. 4 and 5 for example, is the fact that dead man section 42 elevates device 10 above the ground horizontal. This elevation significantly enhances the range of arm 14 which, in prior art devices, cannot dip below a horizontal plane parallel to the ground. As a result, more range, power, and action is provided for in arm 14.

Additionally, FIGS. 4 and 5 illustrate another important feature of invention 10 wherein power length(s) 18 (and 18') have one end secured at 70 (70') in an elevated position that "points" the power lengths directly at the target area somewhat above the batter's box. As a result, arm 14 is pulled forcefully directly towards the target.

Also shown is arm positioning cord attachment 74 attached to the back of arm 14; dead man stake 76; and rear end stake 78.

FIG. 5 shows ball thrower 10 in the cocked position with ball 28 in cup 16 ready to be thrown. FIG. 5 does not show supplemental power section 68 attached, although it is obvious that it may be used in addition to the primary power section 40. Both FIGS. 4 and 5 show that arm positioning cord 20 passes over the top of the foot of dead man section 42 on its way to the rear of frame 12 where it passes around pulley 32 and is connected to arm 14 at arm positioning cord attachment 74.

FIGS. 6, 7, and 8 are close ups of some particulars of the ball thrower 10. FIG. 6 illustrates hand 16. As shown, for example in FIG. 4, top section 80 of hand 16 is flat and is bent in an approximately 90 degree angle from the rear section 82. Top section 80 has central groove 84 formed between a pair of substantially flat surfaces 81A, 81B which form a pair of spaced shoulders 83A, 83B where surfaces 81A, 81B intersect groove 84. A portion of ball 28 may extend into groove 84 when positioned in hand 16 and may be supported by shoulders 83A, 83B, depending upon the size relationship between ball 28 and groove 84. In one preferred embodiment, the diameter of groove 84 is less than the diameter of ball 28 such that ball 28 is supported by the spaced shoulders 83A, 83B during the throwing operation without substantial support from the surface of groove 84. In FIG. 6A, ball 28 rests and is supported partially by rear section 82 and top section 80. Nonetheless, because of the configuration of groove 84 and flat surfaces 81A, 81B, should the ball not be held as in FIG. 6A, but be somewhere else in hand 16 as shown in FIG. 6B, the ball 28 will still be released at the same angle and reach the same position at the batter's box as the previous pitch as illustrated by the directional arrows. Hand 16 may also be rotatably connected to arm 14 by means readily known in the art but not shown. To function properly, rear section 82 of hand 16 should sit at an angle of approximately 135 degrees from arm 14 as shown by angle A of FIG. 4, which positions top section 80 and, therefore, shoulders 83A, 83B at an angle of approximately 45 degrees as shown by angle B in FIG. 4 With a rotatable hand 16, the hand can be rotated forward a few degrees for faster speeds and backward a few degrees for slower speeds. This ensures delivery of ball 28 exactly on target.

FIG. 7 illustrates power length 18 and tapered connector 86. Tapered connector 86 has an integral flattened section 88 through which connection hole 90 is drilled. Restraining groove 92 is formed in the body of tapered connector 86 so that when tapered connector 86 is inserted into power length 18, restraining pincher 94, of ordinary design known in the art, can be located over restraining groove 92 and drawn tight so that power length 18 is firmly held within restraining groove 92 and tapered connector 86 is securely attached to power length 18 thereby. The tapered shape of connector 86 reduces wear and tear on surgical tubing 18 as it stretches over the connector.

FIG. 8 illustrates the lower rear section of self-loading trough 30 with ball 28 in place. As shown in FIG. 4, for example, trough 30 is removably attachable to frame 12 in the area of rotatable attachment 34 so that the front end of trough 30 is elevated above the ground and that balls 28 roll by force of gravity to the rear section illustrated in FIG. 8. The rear section of trough 30 extends beyond the rear end of frame 12 as illustrated, once again, in FIGS. 4 and 5 for example, and has a loading lever 96 constantly biased by spring 98 in the upward position so that loading lever 96 prevents balls 28 from exiting trough 30 at the rear. Trough 30 and arm 14 and handle 16 are designed so that when arm 14 is drawn backward, hand 16 pushes lever 96 down and allows ball 28 to roll into hand 16. FIG. 8 shows lever 96 in the down position thereby allowing ball 28 to roll free of trough 30. As arm 14 is allowed to move forward, when cocking handle 22 is placed in the selected adjustment hole 64 of peg board 24, loading lever 96 will be raised by spring 98 so that additional balls 28 are retained within trough 30.

In operation, set up of ball thrower 10 is simply accomplished. To begin with, peg board 24 is located in the preferred area, batter's box, selected by batter 26 by means of driving a stake through stake hole 66. Removably attachable anchor 60 is then attached to peg board 64 at the free end of peg board 24. The batter 26 then walks to ball thrower 10, grabs frame 12 and walks backward from the batter's box with frame 12 until arm 14 has been pulled to an upright position approximately perpendicular to the ground. Ball thrower 10 is designed so that power length 18, when arm 14 is in the perpendicular position, will be stretched to approximately 100% of its original length. As a result, when in this "uncocked" position as shown in FIG. 9 for example, power length 18 will be stretched and pulling on arm 14.

Once frame 12 is correctly positioned, the device is rested on the ground and rear end stake 78 driven into the ground to secure ball thrower 10 in the proper position. Batter 26 then moves to the front of frame 12 and drives dead man stakes 76 and returns to the batter's box.

As illustrated in FIGS. 9 and 10, batter 26 then grasps cocking handle 22, and by means of handle connecting cord 54, pulls arm positioning cord 20 towards the batter's box. Because arm positioning cord 20 is attached to arm 14 at attachment 74, arm 14 is drawn backward and power length 18, and 18' if attached, is stretched further. Batter 26 continues to pull cocking hand 22 until hand 16 depresses loading lever 96 and ball 28 is released into hand 16. The batter then eases arm 14 forward and places peg 48 in any one of the numbered adjustment holes 64 in peg board 24. The ball thrower 10 is now in the "cocked" position as illustrated in FIG. 10. At this point, batter 26 assumes a normal batting stance. Because cocking handle 22 has upwardly sloping handle 50, as shown in FIGS. 10 and 11 for instance, batter 26 then can use his foot to gently lift cocking handle 22 just enough to release peg 48 from adjustment hole 64. At this moment, power length 18 begins to draw, with ever increasing power, arm 14 rapidly forward towards the batter. Upon reaching the uncocked position previously selected by batter 26, arm positioning cord 20 stops the forward motion of arm 14 and the ball 28 is thrown forward towards the batter. It should be pointed out that arm 14 is constructed of any light weight resilient and strong material preferably with some small degree of flexibility so that there is not the abrupt impact stop of previous devices but so that it duplicates the natural fluid throwing motion, as close as possible, of the human arm.

As previously disclosed, the inventor has determined that balls may be thrown in a wide variety of speeds by the simple means of using power lengths 18 of different elasticities. A piece of surgical tubing, for instance with very high elasticity, would throw a ball slowly and softly. A less elastic piece of surgical tubing will obviously increase the speed. By means of the addition of supplemental power section 68, a variety of speeds may be obtained from slow to fast by combining weak power lengths with stronger ones and so forth. The inventors believe that speeds approximately 100 m.p.h. are attainable through this device.

Should the batter desire to throw fly balls as illustrated in FIG. 11, anchor 60 is simply moved forward along peg board 24 so that the uncocked position is in a more rearward direction. As a result, when cocking handler 22 is released the arm comes to rest more quickly and the ball is thrown in a more upward direction. Ground balls may also be thrown by reversing this process. As a result of this simple means, balls may be thrown across the whole range, from fly balls to batting, to ground balls with a single device.

It should be emphasized that the batter has control over the area where the ball is to be pitched to a degree heretofore unknown. That is, by the simple means of placing cocking handle 22 in a higher numbered adjustment hole 64, the ball will be raised in the strike zone. By placing cocking handle 22 in a lower numbered adjustment hole 64 than the previous pitch, the ball will be lowered in the strike zone. The benefits of this are obvious in that not only can a single batter practice pitches in a wide variety of locations, but batters of different heights may be easily accommodated one after another without complicated removal and reassembly of the device as required by prior art machines.

An added and extremely important advantage of this device is the fact, as shown in FIG. 2, that it may be disassembled, partially or totally, into a small number of pieces for transportation. The device is not bulky, is lightweight and easy to transport, assemble, set up, and utilize.

Further, a single operator may utilize the invention or, a coach may control the delivery of the pitch to the batter by simply holding onto cocking handle 22, not placing it in an adjustment hole 64, and releasing cocking handle 22 when the coach and the batter are ready. If this mode of operation is to be used often, the shape of cocking handle 22 may be modified to operate more efficiently and to eliminate peg 48.

Another advantage of ball thrower 10 over prior art inventions is hand 16. Prior art devices were unable to ensure that the ball 28 would leave their devices at consistently the same angle. By combination of flat top section 80 with an approximately 90 degree rear angle section 82, and central groove 84, ball 28 is consistently positioned for throwing. Even if ball 28 is not located in the crux of hand 16, as shown in FIG. 6B, because of its construction, hand 16 must release the ball at the same angle time and time again. Prior art devices cause the angle of delivery to differ from throw to throw.

Figure 12:
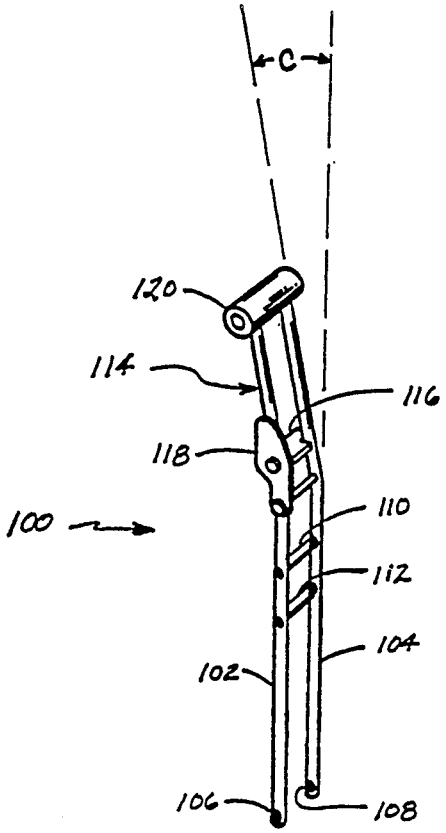
FIG. 12 is a perspective view illustrating a second embodiment of the arm and hand of the present invention.

FIG. 12 illustrates another embodiment of arm 14 and hand 16. In the embodiment shown in FIG. 12, arm 14 and hand 16 have been replaced by arm assebly 100 having a pair of substantially parallel members 102 and 104 which may be rotatably mounted at one end to rotatable attachment 34 shown in FIG. 1. This attachment may be done by inserting a bolt through holes 106, 108 at the lower end of members 102, 104 as shown in FIG. 12.

Members 102, 104 may be made of any suitable, substantially rigid material such as, for example, tubular steel or aluminum. The central portion of members 102, 104 are provided with attachment means for attaching one end of power length 18 to arm assembly 100. In this embodiment, power length 18 may be releaseably attached to arm supports 110 and 112 connected between members 102, 104.

As can be seen in FIG. 12, arm assembly 100 includes a hand portion at its upper end as shown in FIG. 12, adapted for receiving and releaseably supporting ball 28 during operation. In this embodiment, members 102, 104 are of unitary construction and extend such that they form hand assembly portion 114 of arm assembly 100. However, as can be understood, hand portion 114 may be fabricated independently of the lower portions of members 102, 104. In FIG. 12, hand assembly portion 114 includes the upper portions of members 102, 104 which are maintained in spaced parallel relationship, the distance between members 102, 104 being less than the diameter of ball 28. Hand portion 114 may also include a rear section piece 116 attached to members 102, 104 and oriented substantially perpendicular to the upper portion of members 102, 104 which form a portion of hand assembly 114. Rear section piece 116 provides some partial support to ball 28 during operation, especially during loading and perhaps the early portion of the throwing movement, similar to rear section 82 as previously described.

In addition to rear section piece 116, side plate guard 118 is shown in FIG. 12 attached to member 102 adjacent to piece 116. Side plate guard 118 is mounted to member 102 such that during operation when arm assembly 100 is drawn backwards and loading lever 96 is pushed down as previously described in connection with FIG. 8, ball 28 is allowed to roll on to hand assembly 114 and contact piece 116 to be retained on assembly 114 and supported principally by parallel members 102, 104 and to some extent by piece 116.

At the end of hand assembly 114 is pad 120 which covers a spacer piece (not shown). The spacer piece may be a rigid bolt similar to supports 110, 112, which maintain members 102, 104 in a spaced relationship while providing strength, rigidity, and support to arm assembly 100. Pad 120 has been provided for safety reasons to prevent injury to an operator or bystander who may somehow be hit by arm 100 during operation.

As can be understood from FIG. 12, hand assembly 114 forms an angle of approximately 45 degrees, with respect to the lower portions of members 102, 104 as shown in FIG. 12 by angle C.

During operation, it is believed that ball 28 is supported principally by the arcuate surfaces formed by the upper portions of tubular members 102, 104 in a manner similar to the support provided by shoulders 83A, 83B as previously described so that ball 28 is released by hand portion 114 at the same angle with respect to the horizontal time and time again regardless of where along members 102, 104 of hand portion 114 ball 28 actually is positioned.

It is believed that this use of a pair of straight, parallel support members to releaseably support ball 28 provides a much improved hand portion for use on a ball throwing device.

While the ball thrower of the present invention has been disclosed in connection with manual operation, it should be appreciated that the device is capable of attachment to a small electrically driven winch (not shown) that would operate arm 14 upon demand of batter 26 in much the same way as the manual cocking handle 22 operates. Further, the present invention provides an improved ball thrower which can be easily manipulated in order, for example, to vary the location of pitches to an individual batter; to accommodate for different height batters; to vary the velocity of thrown pitches; as well as enabling the batter to throw fly balls, strikes or grounders. The ball thrower is simple and reliable, easy to assemble and may be remotely operated by a single individual, the batter. Thus, the ball thrower of the present invention has a variety of important advantages over the prior art.

While the present invention has been disclosed in connection with the preferred embodiment thereof, it should be understood that there may be other embodiments which fall within the spirit and scope of the invention as defined by the following claims:

What is claimed is:

1. A ball throwing device comprising:

(a) a frame;

(b) an arm body rotatably mounted to said frame;

(c) a biasing means connected to said arm body and to said frame to normally bias said arm body in an uncocked position;

(d) means for positioning said arm body in a cocked position;

(e) means for releasing said arm body from the cocked position so that said arm body is pulled to the uncocked position by said biasing means and said ball is thrown; and (f) a hand portion associated with said arm body, said hand portion having a pair of spaced, substantially parallel members for releaseably supporting the ball to be thrown as the arm body moves from the cocked position to the uncocked position, and wherein said arm body and said hand portion are formed by said substantially parallel members.

2. The device of claim 1 wherein said parallel members include substantially arcuate surfaces adjacent said ball.

3. An arm assembly for use in a ball throwing device, said assembly comprising:

an arm body rotatably mounted to said device; and a hand portion associated with said arm body, said hand portion having a pair of spaced, substantially parallel members for releaseably supporting the ball to be thrown, and wherein said arm body and said hand portion are formed by said substantially parallel members.

4. The arm assembly of claim 3 wherein said parallel members include substantially arcuate surfaces adjacent said ball.

5. A ball throwing device comprising:

(a) a frame;

(b) an arm body rotatably mounted to said frame;

(c) a hand portion associated with said arm body, said hand portion having a pair of spaced, substantially parallel members for releasably supporting the ball to be thrown, and wherein said arm body and said hand portion are formed by said substantially parallel members;

(d) a biasing means connected to said arm body and to said frame to normally bias said arm body in a forward direction;

(e) an arm positioning means having two ends, one end of said positioning means connected to said arm body;

(f) a retaining means adapted for being anchored to the ground, said retaining means attached to the other end of said positioning means; and (g) a cocking handle attached to said arm positioning means between the ends of the positioning means, said handle cooperating with the positioning means upon operation of the device to pull the arm body in a rearward direction so that when said cocking handle is released, said arm body is pulled forward by said biasing means and said ball is thrown.

6. The device of claim 5 wherein said parallel members include substantially arcuate surfaces adjacent said ball.

7. A ball throwing device comprising:

(a) a frame;

(b) an arm body rotatably mounted to said frame;

(c) a hand portion associated with said arm body, said hand portion having a pair of spaced, substantially parallel members for releaseably supporting the ball to be thrown, said arm body and said hand portion are formed by said substantially parallel members;

(d) a biasing means connected to said arm body and to said frame to normally bias said arm body in a forward direction;

(e) an arm positioning means having two ends, one end of said positioning means connected to said arm body;

(f) a means adapted for being anchored to the ground for adjusting the height of a thrown ball;

(g) means for selectively attaching the other end of said arm positioning means to said height adjusting means; and (h) a cooking handle attached to said arm positioning means between the ends of the positioning means, said handle cooperating with the positioning means upon operation of the device to pull the arm body in a rearward direction so that when said cocking handle is released, said arm body is pulled forward by said biasing means and said ball is thrown.

8. The device of claim 7 wherien said parallel members include substantially arcuate surface adjacent said ball.

* * * * *

UNITED STATES PATENT AND TRADEMARK OFFICE

CERTIFICATE OF CORRECTION

PATENT NO. : 4,844,045

DATED : July 4, 1989

INVENTOR(S) : Powell et al

It is certified that error appears in the above-identified patent and that said Letters Patent is hereby corrected as shown below:

Claim 7, column 10, line 31 delete the word "cooking" and insert the word --cocking--.

Claim 8, column 10, line 38 delete the word "wherien" and insert the word --wherein--.

Claim 8, column 10, line 39 delete the word "surface" and insert the word --surfaces--.

Signed and Sealed this

Twenty-fourth Day of April, 1990

*Attest:*

HARRY F. MANBECK, JR.

*Attesting Officer*

*Commissioner of Patents and Trademarks*